US011998038B2

(12) United States Patent
Jeoung et al.

(10) Patent No.: US 11,998,038 B2
(45) Date of Patent: Jun. 4, 2024

(54) METHOD AND DEVICE FOR MANUFACTURING AEROSOL GENERATING ROD, AND AEROSOL GENERATING ARTICLE INCLUDING THE AEROSOL GENERATING ROD MANUFACTURED BY THE METHOD AND DEVICE

(71) Applicant: KT&G CORPORATION, Daejeon (KR)

(72) Inventors: Eun Mi Jeoung, Daejeon (KR); Sung Jong Ki, Daejeon (KR); Min Kyu Kim, Daejeon (KR); Young Joong Kim, Daejeon (KR); In Su Park, Seoul (KR); John Tae Lee, Daejeon (KR); Sun Hwan Jung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 588 days.

(21) Appl. No.: 17/257,084

(22) PCT Filed: Sep. 16, 2020

(86) PCT No.: PCT/KR2020/012506
§ 371 (c)(1),
(2) Date: Dec. 30, 2020

(87) PCT Pub. No.: WO2021/101050
PCT Pub. Date: May 27, 2021

(65) Prior Publication Data

US 2022/0273021 A1 Sep. 1, 2022

(30) Foreign Application Priority Data

Nov. 20, 2019 (KR) ..... 10-2019-0149885

(51) Int. Cl.
*A24C 5/01* (2020.01)
*A24B 15/14* (2006.01)
(Continued)

(52) U.S. Cl.
CPC ..... *A24C 5/01* (2020.01); *A24B 15/14* (2013.01); *A24B 15/167* (2016.11); *A24D 1/04* (2013.01); *A24D 1/20* (2020.01); *A24D 3/17* (2020.01)

(58) Field of Classification Search
CPC ..... A24C 5/01; A24B 15/14; A24B 15/167; A24D 1/04
See application file for complete search history.

(56) References Cited

U.S. PATENT DOCUMENTS 5,724,998 A * 3/1998 Gellatly ..... A24B 15/14 131/374
9,930,910 B2 4/2018 Gindrat
(Continued)

FOREIGN PATENT DOCUMENTS

CN 104411191 A 3/2015
CN 105578906 A 5/2016
(Continued)

OTHER PUBLICATIONS

International Search Report dated Jan. 4, 2021, issued by the International Searching Authority in application No. PCT/KR2020/012506.
(Continued)

*Primary Examiner* — Christopher M Rodd
*Assistant Examiner* — Jennifer A Kessie
(74) *Attorney, Agent, or Firm* — Sughrue Mion, PLLC

(57) ABSTRACT

A method of manufacturing an aerosol generating rod includes providing a sheet of a first non-tobacco material by using at least one first conveying roller; crimping the sheet
(Continued)

of the first non-tobacco material by using a first crimping device; applying an aerosol generating material to at least one surface of the sheet of the first non-tobacco material by using a first spray nozzle; applying a liquid containing a tobacco component to at least one surface of the sheet of the first non-tobacco material by using a slit nozzle; drying the sheet of the first non-tobacco material by using a drying device; and forming the aerosol generating rod by forming the sheet of the first non-tobacco material into a rod by using a rod forming device.

7 Claims, 6 Drawing Sheets

(51) Int. Cl.

| | |
|---|---|
| ***A24B 15/167*** | (2020.01) |
| ***A24D 1/04*** | (2006.01) |
| ***A24D 1/20*** | (2020.01) |
| ***A24D 3/17*** | (2020.01) |

(56) References Cited

U.S. PATENT DOCUMENTS

| | | | | |
|---|---|---|---|---|
| 10,010,110 | B2 | 7/2018 | Metrangolo et al. | |
| 10,206,427 | B2 | 2/2019 | Pijnenburg et al. | |
| 10,624,385 | B2 | 4/2020 | Gindrat | |
| 10,660,364 | B2 | 5/2020 | Ajithkumar et al. | |
| 10,888,120 | B2 | 1/2021 | Zuber | |
| 2005/0049128 | A1* | 3/2005 | Buhl | A24D 3/0237 493/42 |
| 2008/0216854 | A1 | 9/2008 | Nicholls et al. | |
| 2015/0107611 | A1* | 4/2015 | Metrangolo | A24D 1/20 131/329 |
| 2015/0150302 | A1 | 6/2015 | Metrangolo et al. | |
| 2017/0055576 | A1 | 3/2017 | Beeson et al. | |
| 2017/0188636 | A1 | 7/2017 | Li et al. | |
| 2020/0100538 | A1 | 4/2020 | Deforel et al. | |
| 2022/0386681 | A1* | 12/2022 | Spieles | A24B 15/14 |

FOREIGN PATENT DOCUMENTS

| | | | |
|---|---|---|---|
| CN | 105722415 | A | 6/2016 |
| CN | 107307468 | A | 11/2017 |
| JP | 2010-520764 | A | 6/2010 |
| JP | 2017-501676 | A | 1/2017 |
| JP | 2019-000095 | A | 1/2019 |
| KR | 10-2015-0027069 | A | 3/2015 |
| KR | 10-2017-0018456 | A | 2/2017 |
| KR | 10-2017-0102044 | A | 9/2017 |
| KR | 10-2018-0044407 | A | 5/2018 |
| KR | 10-2019-0040885 | A | 4/2019 |
| KR | 10-2019-0049135 | A | 5/2019 |
| KR | 10-2019-0075182 | A | 6/2019 |
| KR | 10-2019-0100206 | A | 8/2019 |
| KR | 10-2019-0119465 | A | 10/2019 |
| WO | 2013/098409 | A1 | 7/2013 |
| WO | 2013/178769 | A1 | 12/2013 |
| WO | 2016/023965 | A1 | 2/2016 |
| WO | 2017/068091 | A1 | 4/2017 |
| WO | 2017/202953 | A1 | 11/2017 |

OTHER PUBLICATIONS

Communication dated Jun. 29, 2021, from the Korean Intellectual Property Office in application No. 10-2019-0149885.

Office Action dated Dec. 23, 2021 In Korean Application No. 10-2019-0149885.

Office Action dated Mar. 8, 2022 in Japanese Application No. 2020-570461.

Communication dated Mar. 1, 2022 from the Chinese Patent in Chinese Application No. 202080004852.1.

Extended European Search Report dated May 11, 2022 in European Application No. 20820307.5.

* cited by examiner

METHOD AND DEVICE FOR MANUFACTURING AEROSOL GENERATING ROD, AND AEROSOL GENERATING ARTICLE INCLUDING THE AEROSOL GENERATING ROD MANUFACTURED BY THE METHOD AND DEVICE

This application is a National Stage of International Application No. PCT/KR2020/012506 filed Sep. 16, 2020, claiming priority based on Korean Patent Application No. 10-2019-0149885 filed Nov. 20, 2019.

TECHNICAL FIELD

The present disclosure relates to method and device for manufacturing an aerosol generating rod, and an aerosol generating article including the aerosol generating rod manufactured by the method and device.

BACKGROUND ART

Recently, the demand for alternative methods of overcoming the shortcomings of general cigarettes has increased. For example, there is an increasing demand for a system for generating aerosols by heating a cigarette by using an aerosol generating device, rather than by burning cigarettes. A cigarette used together with a heating-type aerosol generating device needs to be manufactured to have a structure suitable for providing a user with sufficient smoking taste and amount of aerosols by only heating, rather than burning.

DESCRIPTION OF EMBODIMENTS

Technical Problem

Provided are method and device for manufacturing an aerosol generating rod having a structure suitable for providing a user with sufficient smoking taste and amount of aerosols, and an aerosol generating article including the aerosol generating rod manufactured by the method and device. The technical problems of the present disclosure are not limited to the above-described description, and other technical problems may be derived from the embodiments to be described hereinafter.

Solution to Problem

Various embodiments may provide an aerosol generating article including an aerosol generating rod including a sheet of a first non-tobacco material to which an aerosol generating material is applied on at least one surface and then a liquid containing a tobacco component is additionally applied; a cooling section located downstream of the aerosol generating rod and configured to cool aerosols generated from the aerosol generating rod; and a filtering section located downstream of the cooling section. In addition, various embodiments may provide method and device for manufacturing the above-described aerosol generating rod.

Advantageous Effects of Disclosure

The present disclosure may provide method and device for manufacturing an aerosol generating rod, and an aerosol generating article including the aerosol generating rod manufactured by the method and device. In detail, the method and device for manufacturing the aerosol generating rod according to the present disclosure may manufacture the aerosol generating rod by using a sheet of a non-tobacco component to which an aerosol generating material and a liquid containing a tobacco component are applied to at least one surface of the sheet. As described above, because the tobacco material is not directly used as a material generating aerosols, the occurrence of negative tobacco taste accompanying as the tobacco material is heated to a high temperature may be prevented. In addition, because the aerosol generating material is present in a form absorbed or applied to the sheet of the non-tobacco material, leakage may be prevented.

The method and device for manufacturing an aerosol generating rod according to the present disclosure may spray a sufficient amount of the aerosol generating material on the at least one surface of the sheet of the non-tobacco material by using a spray nozzle, thereby manufacturing a cigarette that provides a user with a sufficient amount of aerosols only by heating rather than burning. In addition, the method and device for manufacturing the aerosol generating rod according to the present disclosure may uniformly apply the liquid containing the tobacco component to the at least one surface of the sheet of the non-tobacco material by using a slit nozzle, thereby manufacturing a cigarette that provides the user with a smoking taste as desired.

BEST MODE

Figure 1:
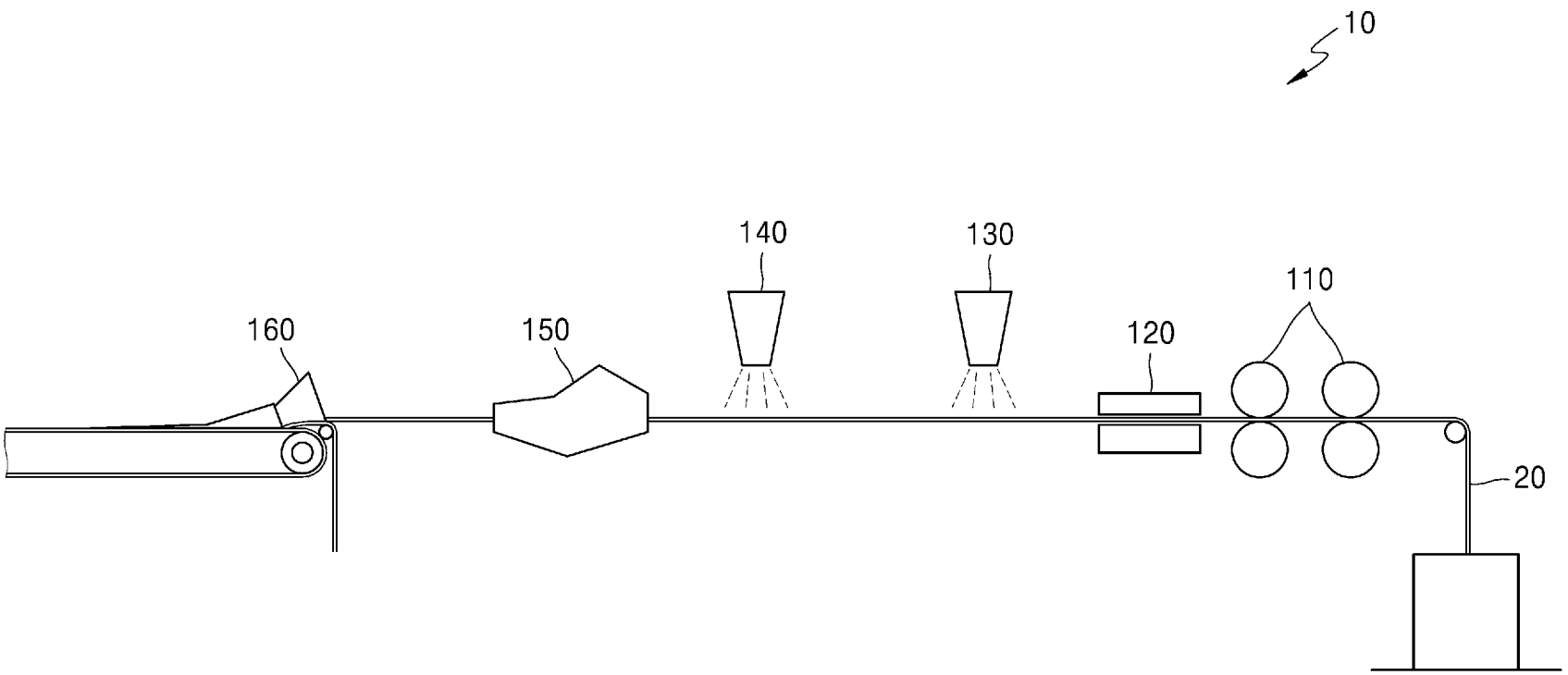
FIG. 1 is a diagram illustrating an example of a device for manufacturing an aerosol generating rod, according to some embodiments.

An aerosol generating article according to an aspect of the present disclosure may include an aerosol generating rod including a sheet of a first non-tobacco material to which after an aerosol generating material is applied on at least one surface and then a liquid containing a tobacco component is additionally applied; a cooling section located downstream of the aerosol generating rod and configured to cool aerosols generated from the aerosol generating rod; and a filtering section located downstream of the cooling section.

For example, the liquid containing the tobacco component may be uniformly applied according to the entire area of the one surface on which the aerosol generating material is applied.

In addition, the sheet of the first non-tobacco material may be a material other than a tobacco material and may include a polymer material or a cellulose material capable of absorbing the aerosol generating material.

The aerosol generating rod may include about 40 wt % to about 90 wt % of the aerosol generating material in dry weight basis of the aerosol generating rod.

The liquid containing the tobacco component may include a liquid in which tobacco granules or tobacco fine particles are mixed with a liquid binder, and the tobacco granules or the tobacco fine particles may have a size of about 10 μm to about 50 μm.

The liquid binder may include at least one of: at least one binder selected from the group consisting of gum, hydroxypropyl methylcellulose (HPMC), and starch; water; and ethanol.

The aerosol generating rod may further include a sheet of a second non-tobacco material to which only the aerosol generating material is applied to at least one surface of the sheet.

A method of manufacturing an aerosol generating rod according to another aspect of the present disclosure may include providing a sheet of a first non-tobacco material by using at least one first conveying roller; crimping the sheet of the first non-tobacco material by using a first crimping device; applying an aerosol generating material to at least one surface of the sheet of the first non-tobacco material by using a first spray nozzle; applying a liquid containing a tobacco component to at least one surface of the sheet of the first non-tobacco material by using a slit nozzle; drying the sheet of the first non-tobacco material by using a drying device; and forming the aerosol generating rod by forming the sheet of the first non-tobacco material to a rod by using a rod forming device.

The sheet of the first non-tobacco material may be a material other than a tobacco material and may include a polymer material or a cellulose material capable of absorbing the aerosol generating material.

The aerosol generating material may include at least one of glycerin, propylene glycol, ethylene glycol, dipropylene glycol, diethylene glycol, triethylene glycol, tetraethylene glycol, and oleyl alcohol, and the applying of the aerosol generating material may include applying the aerosol generating material to the at least one surface of the sheet of the first non-tobacco material such that the aerosol generating rod includes about 40 wt % to about 90 wt % of the aerosol generating material in dry weight basis of the aerosol generating rod.

The applying of the aerosol generating material may include spraying the aerosol generating material on the at least one surface of the sheet of the first non-tobacco material by using the first spray nozzle.

The applying of the liquid containing the tobacco component may include applying the liquid containing the tobacco component to the at least one surface of the sheet of the first non-tobacco material through a plurality of slits arranged on the slit nozzle to be apart from each other according to a preset interval.

The liquid containing the tobacco component may include a liquid in which tobacco granules or tobacco fine particles are mixed with a liquid binder, and the applying of the liquid containing the tobacco component may include applying the liquid containing the tobacco component including the tobacco granules or the tobacco fine particles having a size of about 10 μm to about 50 μm to the at least one surface of the sheet of the first non-tobacco material.

The liquid binder may include at least one of at least one binder, water, and ethanol, the at least one binder being selected from gum, hydroxypropyl methylcellulose (HPMC), and starch.

The drying of the sheet of the first non-tobacco material may include drying the sheet of the first non-tobacco material by using the drying device set to maintain a temperature in a range of about 70° C. to about 120° C.

The forming of the aerosol generating rod may include gathering the sheet of the first non-tobacco material in a transverse direction with respect to an axis of a conveying direction of the sheet of the first non-tobacco material; forming a continuous rod by surrounding the gathered sheet of the first non-tobacco material with a wrapper; and forming the aerosol generating rod by cutting the continuous rod into a plurality of individual rods.

The method may further include providing a sheet of a second non-tobacco material by using at least one second conveying roller; crimping the sheet of the second non-tobacco material by using a second crimping device; applying the aerosol generating material on at least one surface of the sheet of the second non-tobacco material by using a second spray nozzle; and forming a double sheet by overlapping the sheet of the second non-tobacco material and the sheet of the first non-tobacco material.

In addition, a device for manufacturing an aerosol generating rod according to another aspect of the present disclosure may include at least one first conveying roller configured to provide a sheet of a first non-tobacco material; a first crimping device configured to crimp the sheet of the first non-tobacco material; a first spray nozzle configured to apply an aerosol generating material to at least one surface of the sheet of the first non-tobacco material; a slit nozzle configured to apply a liquid containing a tobacco component to at least one surface of the sheet of the first non-tobacco material; a drying device configured to dry the sheet of the first non-tobacco material, and a rod forming device configured to form the aerosol generating rod by forming the sheet of the first non-tobacco material into a rod.

MODE OF DISCLOSURE

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

In addition, in the present disclosure, while such terms as "first," "second," etc., may be used to describe various components, such components must not be limited to the above terms. The above terms are used only to distinguish one component from another.

Throughout the present disclosure, "upstream" and "downstream" may be determined based on a direction of air flow such that generated aerosols are inhaled into a user's mouth or lung when the user smokes by using an aerosol generating article. For example, in the example of FIG. 5, because aerosols generated in an aerosol generating rod 510 is directed to a filtering section 530 through a cooling section 520, the cooling section 520 is located upstream of the filtering section 530, and the filtering section 530 is located downstream of the cooling section 520. "Upstream" and "downstream" may be determined relatively between components.

Hereinafter, the present disclosure will now be described more fully with reference to the accompanying drawings, in which exemplary embodiments of the present disclosure are shown such that one of ordinary skill in the art may easily work the present disclosure. The disclosure can, however, be embodied in many different forms and should not be construed as being limited to the embodiments set forth herein.

Hereinafter, embodiments of the present disclosure will be described in detail with reference to the drawings.

FIG. 1 is a diagram illustrating an example of a device for manufacturing an aerosol generating rod, according to some embodiments.

Referring to FIG. 1, a device 10 for manufacturing an aerosol generating rod may include at least one first conveying roller 110, a first crimping device 120, a first spray nozzle 130, a slit nozzle 140, a drying device 150, and a rod forming device 160. However, FIG. 1 shows the device 10 for manufacturing the aerosol generating rod with some components related to the present embodiment. Therefore, it will be understood by one of ordinary skill in the art related to the present embodiment that other general-purpose components may be further included in the device 10 for manufacturing the aerosol generating rod, in addition to the components illustrated in FIG. 1.

In addition, although FIG. 1 illustrates each of the at least one first conveying roller 110, the first crimping device 120, the first spray nozzle 130, the slit nozzle 140, the drying device 150, and the rod forming device 160 as an individual component, but it will be understood by one of ordinary skill in the art that at least two of the at least one first conveying roller 110, the first crimping device 120, the first spray nozzle 130, the slit nozzle 140, the drying device 150, and the rod forming device 160 may be integrated to form one component.

Hereinafter, a method of manufacturing an aerosol generating rod by the device 10 for manufacturing the aerosol generating rod will be described in more detail below with reference to FIG. 2.

Figure 2:
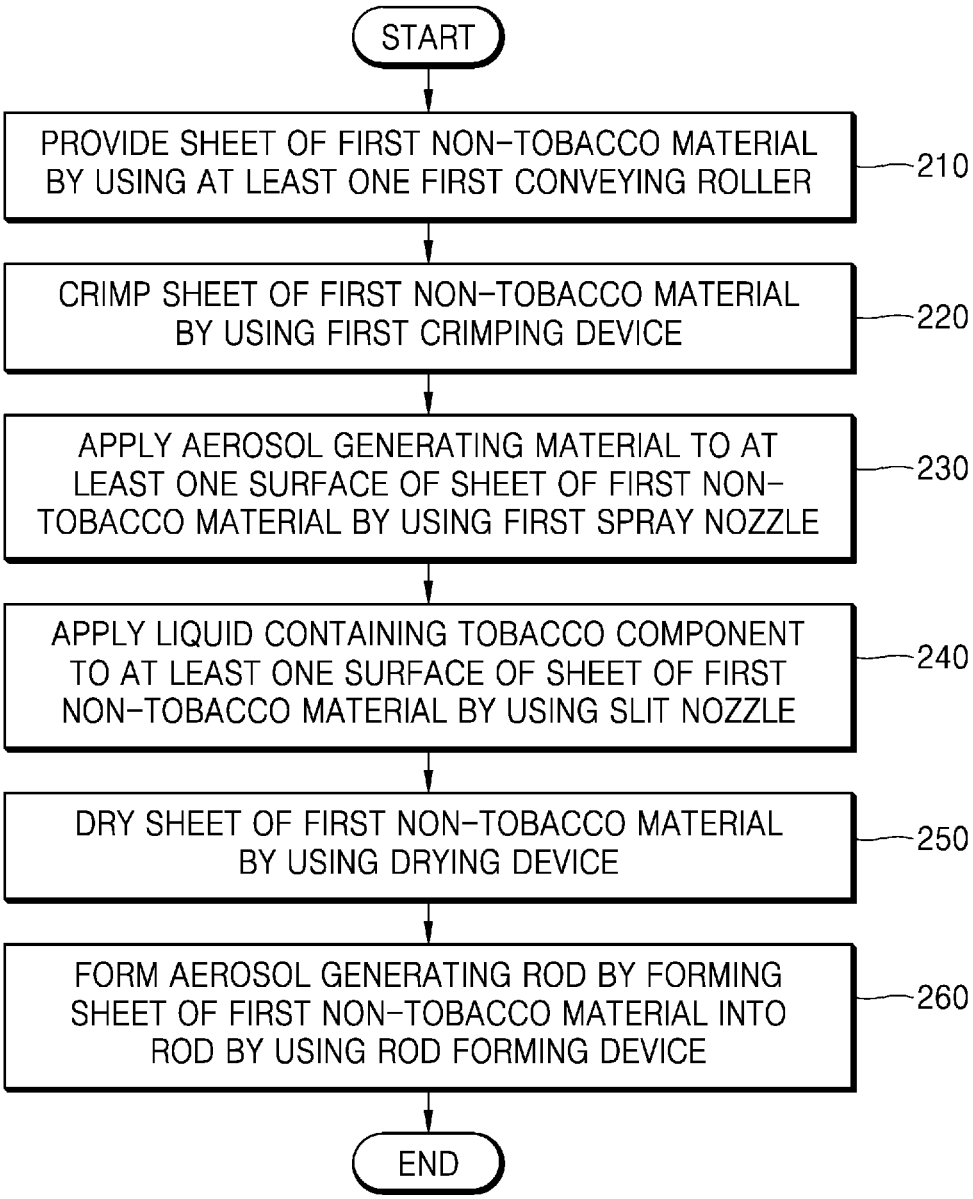
FIG. 2 is a flowchart illustrating a method of manufacturing an aerosol generating rod, according to some embodiments.

FIG. 2 is a flowchart illustrating a method of manufacturing an aerosol generating rod, according to some embodiments. The device 10 for manufacturing the aerosol generating rod may manufacture, according to operations to be described below, the aerosol generating rod by using a sheet 20 of a first non-tobacco material. The sheet 20 of the first non-tobacco material may refer to a sheet made of a non-tobacco material. The non-tobacco material is a material other than a tobacco material, and may be a polymer material or a cellulose material capable of absorbing an aerosol generating material. For example, the sheet 20 of the first non-tobacco material may be a paper sheet that does not generate a smell due to heat even when heated to a high temperature. As a raw material of the paper sheet, birch, bamboo, porous paper, or the like may be used. However, the present disclosure is not limited thereto.

In operation 210, the device 10 for manufacturing the aerosol generating rod may provide the sheet 20 of the first non-tobacco material by using the at least one first conveying roller 110. The at least one first conveying roller 110 refers to a device that fixes a plane material such as a sheet, a paper, or the like between two rollers and moves the plane material in a conveying direction by friction by rotating the rollers. In FIG. 1, the conveying direction of the sheet 20 of the first non-tobacco material may correspond to a direction from the at least one first conveying roller 110 toward the first crimping device 120. Although FIG. 1 illustrates the at least one first conveying roller 110 as including four rollers, but this is only an example. The at least one first conveying roller 110 may include two rollers, and may include a number of rollers greater than four.

In operation 220, the device 10 for manufacturing the aerosol generating rod may crimp the sheet 20 of the first non-tobacco material by using the first crimping device 120. The first crimping device 120 refers to a device that crimps a plane material such as a sheet, a paper, or the like. As the first crimping device 120 crimps the sheet 20 of the first non-tobacco material, a plurality of parallel corrugations or ridges may be formed on the sheet 20 of the first non-tobacco material. However, the present disclosure is not limited thereto, and a wave or sine wave-shaped of corrugations or ridges may be formed on the sheet 20 of the first non-tobacco material.

In operation 230, the device 10 for manufacturing the aerosol generating rod may apply an aerosol generating material to at least one surface of the sheet 20 of the first non-tobacco material by using the first spray nozzle 130. The first spray nozzle 130 refers to a device that applies pressure to the liquid or gas passing through a pipe and spurts the same in the form of a spray. For example, the first spray nozzle 130 may spray the aerosol generating material onto the at least one surface of the sheet 20 of the first non-tobacco material.

For example, the aerosol generating material may include at least one of glycerin, propylene glycol, ethylene glycol, dipropylene glycol, diethylene glycol, triethylene glycol, tetraethylene glycol, and oleyl alcohol, but is not limited thereto. The first spray nozzle 130 may apply the aerosol generating material to the at least one surface of the sheet 20 of the first non-tobacco material such that the aerosol generating rod includes about 40 wt % to about 90 wt % of the aerosol generating material in dry weight basis of the aerosol generating rod. As the aerosol generating material is included as 40 wt % or more in the dry weight basis of the aerosol generating rod, the aerosol generating rod which provides the user with a sufficient amount of aerosols only by heating, rather than burning, may be manufactured. As described above, the device 10 for manufacturing the aerosol generating rod may manufacture an aerosol generating article (for example, a cigarette) that provides the user with a sufficient amount of aerosols only by heating rather than burning by applying a sufficient amount of the aerosol generating material to at least one surface of the sheet 20 of the first non-tobacco material by using the first spray nozzle 130.

In operation 240, the device 10 for manufacturing the aerosol generating rod may apply a liquid containing a tobacco component to the at least one surface of the sheet 20 of the first non-tobacco material by using the slit nozzle 140. The slit nozzle 140 may apply the liquid containing the tobacco component to the at least one surface of the sheet 20 of the first non-tobacco material through a plurality of slits arranged on the slit nozzle 140 to be apart from each other according to a preset interval.

The liquid containing the tobacco component may include a liquid in which tobacco granules or tobacco fine particles are mixed with a liquid binder. When the tobacco granules or the tobacco fine particles are applied by a dropping method, there is a high possibility that the tobacco granules are unevenly applied to the at least one surface of the sheet 20 of the first non-tobacco material, and variations may occur with each aerosol generating rod manufactured by the device 10 for manufacturing an aerosol generating rod. In addition, because the liquid containing the tobacco component has a higher viscosity than the aerosol generating material, applying in a spray method may be inappropriate. To solve the problem according to the above-stated method, the device 10 for manufacturing the aerosol generating rod may uniformly applying the liquid containing the tobacco component on the at least one surface of the sheet 20 of the first non-tobacco material by using the slit nozzle 140, thereby manufacturing an aerosol generating article (for example, cigarettes) which provides the user with a smoking taste as desired.

The tobacco granules or the tobacco fine particles included in the liquid containing the tobacco component may have an appropriate size to be applied through the slit nozzle 140. For example, the tobacco granules or the tobacco fine particles may have a size of about 10 μm to about 50 μm. When the tobacco granules or the tobacco fine particles have a size of less than about 10 μm, the time and cost required for a grinding operation or the like to manufacture the tobacco granules or the tobacco fine particles may be excessively increased, and when the tobacco granules or the tobacco fine particles has a size exceeding about 50 μm, the tobacco granules or the tobacco fine particles may be difficult to be uniformly applied through the slit nozzle 140. Accordingly, the tobacco granules or the tobacco fine particles may have a size corresponding to the above-stated numerical range as an appropriate size.

The liquid binder may include at least one of at least one binder, water, and ethanol, the at least one binder being selected from gum, hydroxypropyl methylcellulose (HPMC), and starch. An appropriate amount of a liquid binder may be mixed with the tobacco granules or the tobacco fine particles such that the liquid containing the tobacco component has an appropriate viscosity level that may be applied through the slit nozzle 140.

Hereinafter, referring to FIGS. 3A and 3B, the method of applying the liquid containing the tobacco component to the at least one surface of the sheet 20 of the first non-tobacco material will be described in more detail below.

Figure 3A:
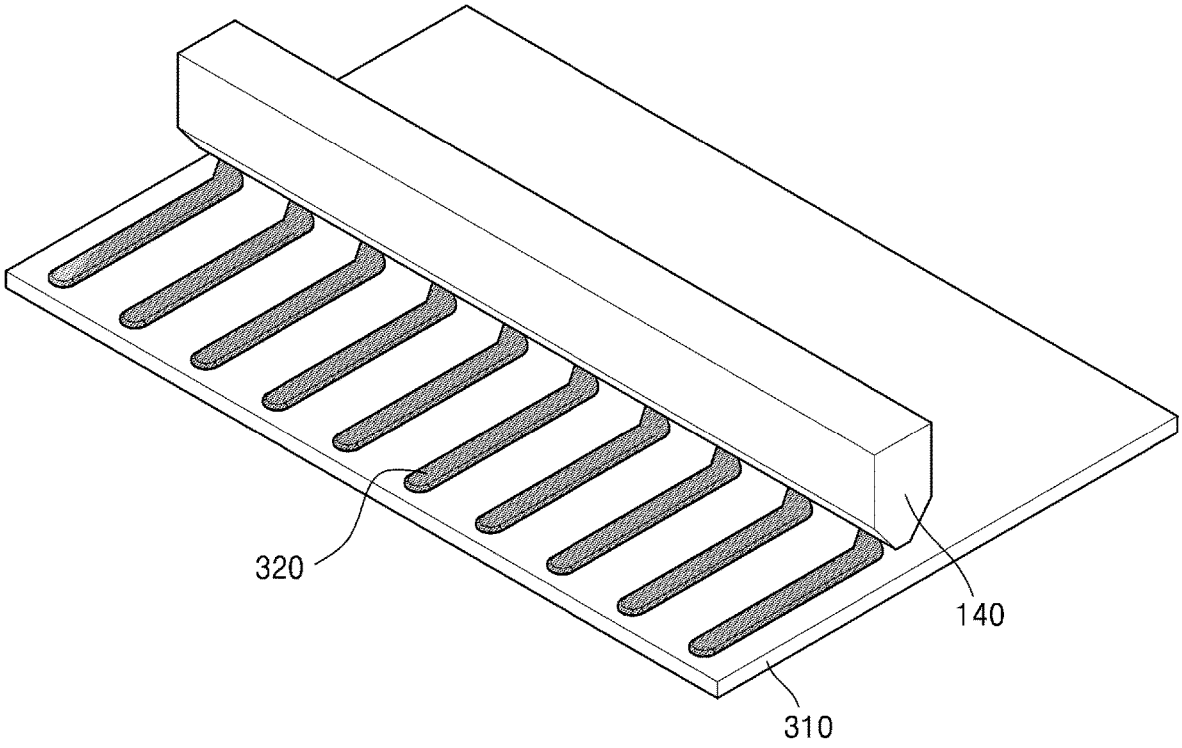
FIGS. 3A and 3B are diagrams for explaining a method of applying a liquid containing a tobacco component to at least one surface of a sheet of a non-tobacco material, according to some embodiments.
Figure 3B:
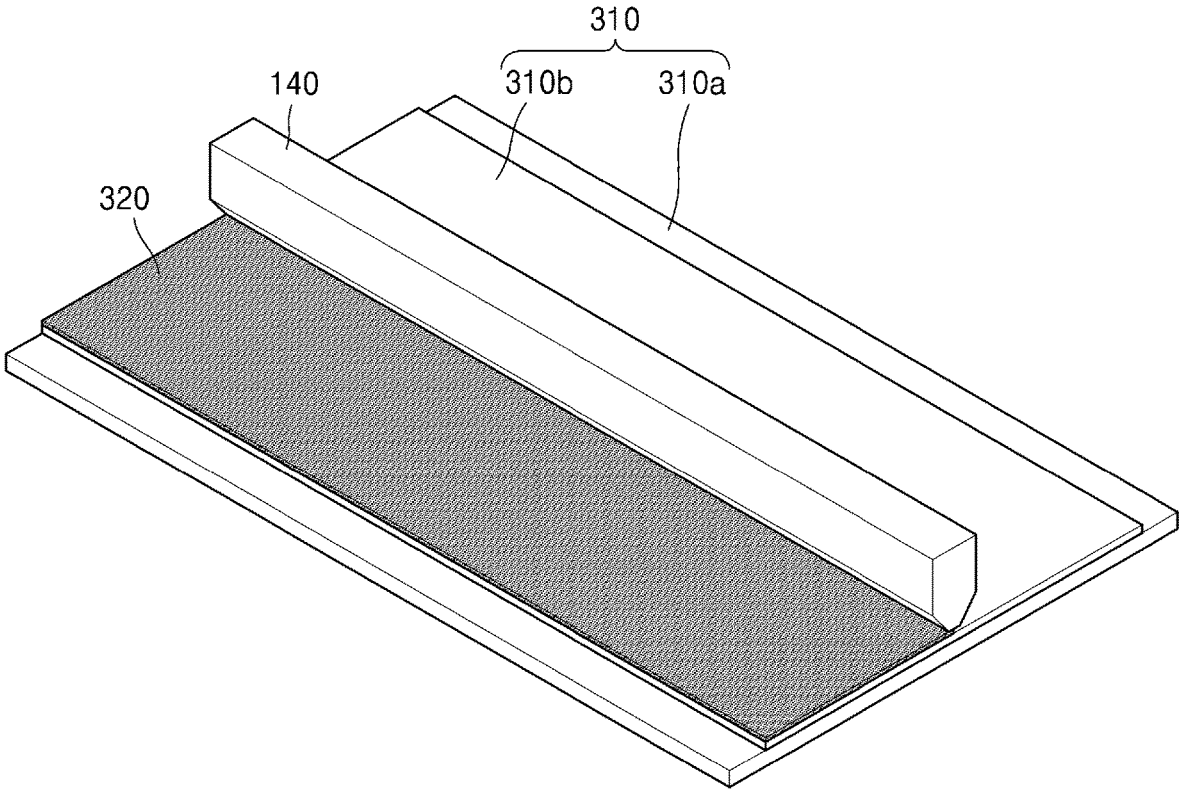

FIGS. 3A and 3B are diagrams for explaining a method of applying the liquid containing the tobacco component to the at least one surface of the sheet of the non-tobacco material, according to some embodiments.

Referring to FIG. 3A, the slit nozzle 140 may apply the liquid 320 containing the tobacco component to a sheet 310 of a non-tobacco material to which an aerosol generating material is applied, so as to be spaced apart by a preset interval. The preset interval at which the liquid 320 containing the tobacco component is applied may correspond to an interval between a plurality of slits arranged on the slit nozzle 140 to be spaced apart. The slit nozzle 140 may uniformly apply a fixed amount of the liquid 320 containing the tobacco component to the sheet 310 of the non-tobacco material coated with the aerosol generating material.

The slit nozzle 140 does not necessarily apply the liquid 320 containing the tobacco component to be spaced apart in a preset interval. For example, as shown in FIG. 3B, the slit nozzle 140 may uniformly apply the liquid 320 containing the tobacco component according to an entire area of the sheet 310 of the non-tobacco material to which the aerosol generating material is applied. In this case, the interval between the plurality of slits that are arranged to be spaced apart on the slit nozzle 140 may be formed narrow enough such that the liquid 320 containing the tobacco component may be uniformly applied according to the entire area of the sheet 310 of the non-tobacco component to which the aerosol generating material is applied. However, the present disclosure is not limited thereto, and the slit nozzle 140 may include a single slit, which has an elongated shape in a transverse direction with respect to an axis of a conveying direction, instead of a plurality of slits.

As shown in FIG. 3B, one surface of a sheet layer 310*a* of the non-tobacco material on which a layer 310*b* of the aerosol generating material is formed and one surface of the sheet layer 310*a* of the non-tobacco material on which the liquid 320 containing the tobacco component is applied may be the same. However, the present disclosure is not limited thereto, and the one surface of the sheet layer 310*a* of the non-tobacco material on which the aerosol generating material is applied and the one surface of sheet layer 310*a* of the non-tobacco material on which the liquid 320 containing the tobacco component is applied may be different from each other.

Referring again to FIGS. 1 and 2, an application thickness of the aerosol generating material or the liquid containing the tobacco component applied to the sheet 20 of the first non-tobacco material is related to an amount of nicotine transferred during smoking and may vary according to a heating condition, but may be preferable to be less than the thickness of a base paper (that is, the thickness of the sheet 20 of the first non-tobacco material). When the application thickness of the aerosol generating material of the liquid containing the tobacco component applied to the sheet 20 of the first non-tobacco material is greater than the thickness of the base paper, the aerosol generating material or the liquid containing the tobacco component applied to the sheet 20 of the first non-tobacco material may be difficult to maintain in shape, and the sheet 20 of the first non-tobacco material is difficult to be made in a rod. However, the present disclosure is not limited thereto.

In operation 250, the device 10 for manufacturing the aerosol generating rod may dry the sheet 20 of the first non-tobacco material by using the drying device 150. The drying device 150 may refer to a heating furnace that heats an interior to a particular temperature. The drying device 150 may be set to maintain a temperature in a range of about 70° C. to about 120° C. When the temperature inside the drying device 150 is less than about 70° C., water or ethanol may not be removed from the sheet 20 of the first non-tobacco material, and when the temperature inside the drying device 150 exceeds about 120° C., nicotine included in the tobacco component or the aerosol generating material may be lost. Accordingly, the drying device 150 may maintain a temperature range corresponding to the above-stated numerical range as an appropriate temperature range. The drying device 150 may have an appropriate length (in proportion to drying time) in the conveying direction such that water or ethanol may be sufficiently removed from the sheet 20 of the first non-tobacco material.

In operation 250, the device 10 for manufacturing the aerosol generating rod may form the sheet 20 of the first non-tobacco material into rods by using the rod forming device 160, thereby forming the aerosol generating rod. The rod forming device 160 may gather the sheet 20 of the first non-tobacco material in the transverse direction with respect to the axis of the conveying direction of the sheet 20 of the first non-tobacco material, and form a continuous rod by surrounding the gathered sheet 20 of the first non-tobacco material with a wrapper. At this time, the sheet 20 of the first non-tobacco material gathered in the transverse direction may have a width of about 150 mm to about 250 mm. The device 10 for manufacturing the aerosol generating rod may form the aerosol generating rod by cutting the continuous rod formed by the rod forming device 160 into a plurality of individual rods to have a length of about 8 mm to about 15 mm. A cutting device for cutting the continuous rod may be arranged in an appropriate position in the rod forming device 160 or the device 10 for manufacturing the aerosol generating rod.

As described above, according to the method of which the device 10 for manufacturing the aerosol generating rod manufactures the aerosol generating rod, because the tobacco material is not directly used as a material generating aerosols, the occurrence of a negative tobacco taste accompanying the heating of the tobacco material to a high temperature may be prevented. In addition, because the aerosol generating material is present in a form absorbed or applied to a sheet of a non-tobacco material, leakage may be prevented.

Figure 4:
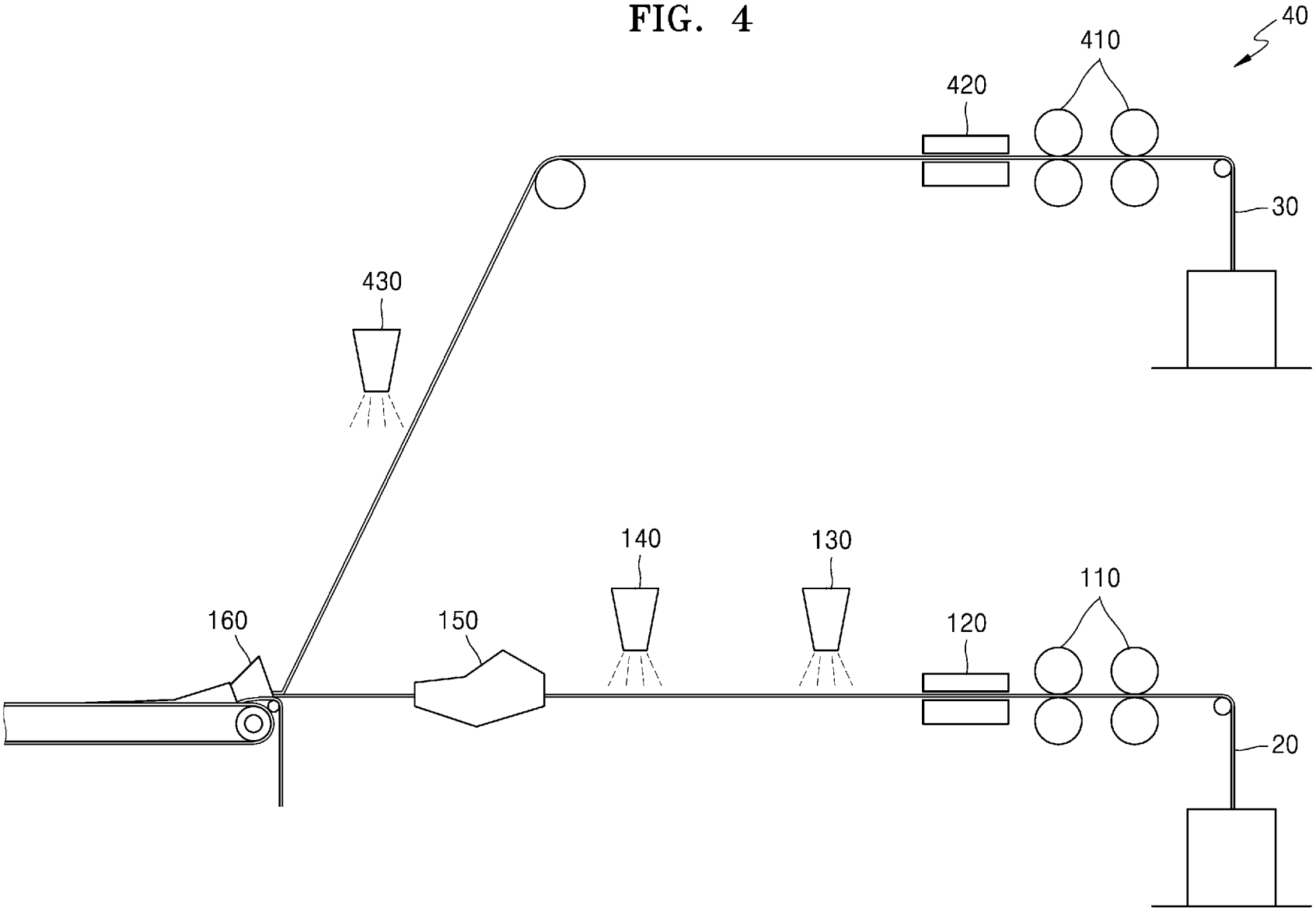
FIG. 4 is a diagram illustrating another example of a device for manufacturing an aerosol generating rod, according to some embodiments.

FIG. 4 is a diagram illustrating another example of a device for manufacturing an aerosol generating rod; according to some embodiments.

Referring to FIG. 4, a device 40 for manufacturing the aerosol generating rod may further include at least one second conveying roller 410, a second crimping device 420, and a second spray nozzle 430, in addition to the at least one first conveying roller 110, the first crimping device 120, the first spray nozzle 130, the slit nozzle 140, the drying device 150, and the rod forming device 160 included in the device 10 of FIG. 1 for manufacturing the aerosol generating rod. Each of at least one of the second conveying roller 410, the second crimping device 420, and the second spray nozzle 430 may be the same as at least one of the first conveying roller 110, the first crimping device 120, and the first spray nozzle 130, and may only be different in that an operation is performed on a sheet 30 of a second non-tobacco material instead of the sheet 20 of the first non-tobacco material.

For example, the at least one second conveying roller 410 may provide the sheet 30 of the second non-tobacco material, the second crimping device 420 may crimp the sheet 30 of the second non-tobacco material, and the second spray nozzle 430 may apply the aerosol generating material on at least one surface of the sheet 30 of the second non-tobacco material. The device 40 for manufacturing the aerosol generating rod may form a double sheet by overlapping the sheet 30 of the second non-tobacco material and the sheet 20 of the first non-tobacco material, and may form the sheet 30 of the second non-tobacco material and the sheet 20 of the first non-tobacco material into a rod together by conveying the double sheet to the rod forming device 160.

As described above, the device 40 for manufacturing the aerosol generating rod may minimize the loss of the tobacco granules or the tobacco fine particles applied to the sheet 20 of the first non-tobacco material and further secure an amount of the aerosol generating material by forming the double sheet by overlapping the sheet 30 of the second non-tobacco material to which only the aerosol generating material is applied with the sheet 20 of the first non-tobacco material. Accordingly, the aerosol generating rod manufactured by the device 40 for manufacturing the aerosol generating rod may have a structure suitable for providing the user with a sufficient smoking taste and amount of aerosols only by heating, rather than burning.

The sheet 20 of the first non-tobacco material and the sheet 30 of the second non-tobacco material which are conveyed to the rod forming device 160 may be made of the same material or different materials. The sheet 30 of the second non-tobacco material may have the same width as the sheet 20 of the first non-tobacco material, for example, about 150 mm to about 250 mm, but may have a width different from the sheet 20 of the first non-tobacco material. An amount of the aerosol generating material applied to the sheet 30 of the second non-tobacco material may not be greater than 1.5 times an amount of the aerosol generating material applied to the sheet 20 of the first non-tobacco material.

The aerosol generating material applied to the sheet 20 of the first non-tobacco material or the sheet 30 of the second non-tobacco material may include propylene glycol and glycerin, and ratios of the propylene glycol and glycerin applied to the sheet 20 of the first non-tobacco material or the sheet 30 of the second non-tobacco material may be set to be the same or different from each other. For example, each of the ratios of the propylene glycol and the glycerin applied to the sheet 20 of the first non-tobacco material or the sheet 30 of the second non-tobacco material may be selected from one of 5:5, 4:6, 3:7, 2:8, 1:9, 6:4, 7:3, 8:2, or 9:1. However, the present disclosure is not limited thereto.

Although an embodiment in which the device 40 for manufacturing the aerosol generating rod includes the second spray nozzle 430 has been described with reference to FIG. 4, the device 40 for manufacturing the aerosol generating rod may not include the second spray nozzle 430. In this case, the sheet 20 of the first non-tobacco material to which the liquid containing the aerosol generating material or the tobacco component is applied may be overlapped with the sheet 30 of the second non-tobacco material to which both the aerosol generating material and the liquid containing the tobacco component are not applied to form a double sheet, thereby only the effect of minimizing the loss of the tobacco granules or the tobacco fine particles applied to the sheet 20 of the first non-tobacco material may be additionally obtained.

Figure 5:
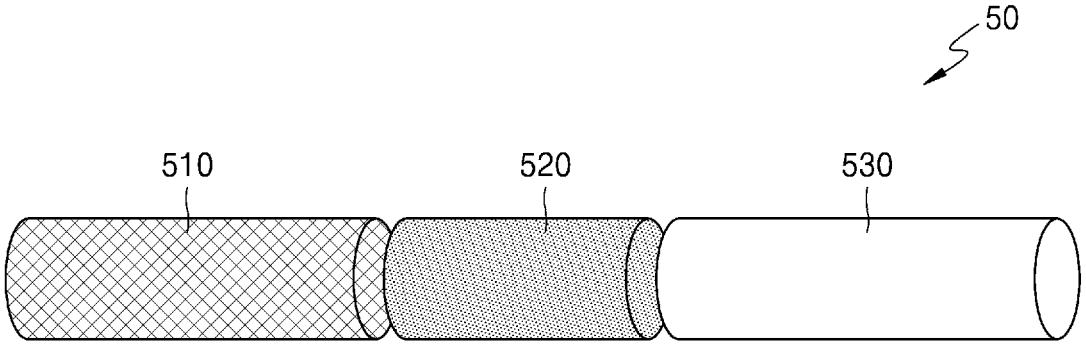
FIG. 5 is a diagram illustrating an example of an aerosol generating article including an aerosol generating rod manufactured by a method of manufacturing an aerosol generating rod, according to some embodiments.

FIG. 5 is a diagram illustrating an example of an aerosol generating article including an aerosol generating rod manufactured by a method of manufacturing the aerosol generating rod, according to some embodiments.

Referring to FIG. 5, an aerosol generating article 50 corresponds to a cigarette used with a heating-type aerosol generating device, and may include the aerosol generating rod 510, the cooling section 520, and the filtering section 530. However, FIG. 5 illustrates the aerosol generating article 50 with some components related to the embodiment. Accordingly, it will be understood by one of ordinary skill in the art pertaining to the present embodiment that other general-purpose components may be further included in the aerosol generating article 50 in addition to the components illustrated in FIG. 5.

The aerosol generating rod 510 may correspond to the aerosol generating rod manufactured by the device 10 for manufacturing the aerosol generating rod or the device 40 for manufacturing the aerosol generating rod described with reference to FIGS. 1 to 4. Accordingly, the aerosol generating rod 510 may include a sheet of a non-tobacco material to which an aerosol generating material and a liquid containing a tobacco component are applied to one surface or both surfaces. In addition, the aerosol generating rod 510 may include other additives, such as flavors, a wetting agent, or the like. The aerosol generating rod 510 may include a flavored liquid, such as menthol or a moisturizer, which is injected to the aerosol generating rod 510.

When a width of the sheet of the non-tobacco material included in the aerosol generating rod 510 is too wide, the size of air gaps formed by the sheet of the non-tobacco material gathered in the aerosol generating rod 510 may decrease, and accordingly, resistance-to-draw in smoking of the aerosol generating article 50 may be excessively increased. On the contrary, when the width of the sheet of the non-tobacco material included in the aerosol generating rod 510 is too narrow, the size of air gaps formed by the sheet of the non-tobacco material gathered in the aerosol generating article 50 may increase, and accordingly, sufficient resistance-to-draw in smoking of the aerosol generating article 50 may not be provided. As described above, the resistance-to-draw of the entire aerosol generating article 50 may be determined according to the width of the sheet of the non-tobacco material, the width of the sheet of the non-tobacco material may be appropriately set. For example, the width of the sheet of the non-tobacco material included in the aerosol generating article 50 may be about 150 mm to 250 mm, and preferably about 180 mm to 220 mm. However, the present disclosure is not limited thereto.

According to some embodiments, the aerosol generating rod 510 may be surrounded by a heat conductive material. For example, the heat conductive material may be, but is not limited to, a metal foil such as aluminum foil. For example, the heat conductive material surrounding the aerosol generating rod 510 may uniformly distribute heat transmitted to the aerosol generating rod 510, and thus, the heat conductivity applied to a tobacco rod may be increased and taste of the tobacco may be improved. In addition, the heat conductive material surrounding the aerosol generating rod 510 may function as a susceptor heated by an induction heater. Here, although not illustrated in the drawings, the aerosol generating rod 510 may further include an additional susceptor, in addition to the heat conductive material surrounding the aerosol generating rod 510.

In addition, the aerosol generating rod 510 may have an appropriate length in a range of about 8 mm to about 15 mm. There may be a certain limit on the length of the aerosol generating article 50 in a design process, and as the aerosol generating rod 510 is formed as a single segment including both the tobacco component and the aerosol generating material, autonomy in designing the length of the cooling section 520 to be described below may be increased. Accordingly, the cooling section 520 may have a length sufficient to provide sufficient cooling to main-stream smoke delivered to a mouth-end of the aerosol generating article 50.

The cooling section 520 may be made of a polymer material or a biodegradable polymer material, and may have a cooling function. For example, the cooling section 520 may be made of pure polyactic acid only, but is not limited thereto. In addition, the cooling section 520 may be made of a cellulose acetate filter having a plurality of holes. However, the cooling section 520 is not limited to the above-described example and is not limited as long as the cooling section 520 cools aerosols. For example, the cooling section 520 may be a tube filter or a paper tube filter including a hollow.

The filtering section 530 may be a cellulose acetate filter. Shapes of the filtering section 530 are not limited. For example, the filtering section 530 may be a cylinder-type rod or a tube-type rod having a hollow inside. In addition, the filtering section 530 may be a recess-type rod. When the filtering section 530 includes a plurality of segments, at least one of the plurality of segments may have a different shape.

The filtering section 530 may be formed to generate flavors. For example, a flavoring liquid may be injected onto the filtering section 530, or an additional fiber to which a flavoring liquid is applied may be inserted into the filtering section 530.

In addition, at least one capsule may be included in the filtering section 530. Here, the capsule may generate a flavor or an aerosol. For example, the capsule may have a configuration in which a liquid including a flavoring material is wrapped with a film. The capsule may have a spherical or cylindrical shape, but is not limited thereto.

The aerosol generating article 50 may be packaged via a wrapper (not shown). The wrapper may have at least one hole through which external air may be introduced or internal air may be discharged. The wrapper may be a single wrapper, but may be a combination of a plurality of wrappers.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. A method of manufacturing an aerosol generating rod, the method comprising:

providing a sheet of a first non-tobacco material by using at least one first conveying roller;

crimping the sheet of the first non-tobacco material by using a first crimping device;

applying an aerosol generating material to at least one surface of the sheet of the first non-tobacco material by using a first spray nozzle;

applying a liquid containing a tobacco component to at least one surface of the sheet of the first non-tobacco material by using a slit nozzle;

drying the sheet of the first non-tobacco material by using a drying device; and forming the aerosol generating rod by forming the sheet of the first non-tobacco material into a rod by using a rod forming device, wherein the applying of the liquid containing the tobacco component comprises applying the liquid containing the tobacco component to the at least one surface of the sheet of the first non-tobacco material, through a plurality of slits arranged on the slit nozzle, wherein the liquid is applied in strips that are spaced apart from each other on the at least one surface of the sheet of the first non-tobacco material, according to a preset interval.

2. The method of claim 1, wherein the aerosol generating material comprises at least one of glycerin, propylene glycol, ethylene glycol, dipropylene glycol, diethylene glycol, triethylene glycol, tetraethylene glycol, and oleyl alcohol, and the applying of the aerosol generating material comprises applying the aerosol generating material to the at least one surface of the sheet of the first non-tobacco material such that the aerosol generating rod comprises about 40 wt % to about 90 wt % of the aerosol generating material in dry weight basis of the aerosol generating rod.

3. The method of claim 1, wherein the applying of the aerosol generating material comprises spraying the aerosol generating material on the at least one surface of the sheet of the first non-tobacco material by using the first spray nozzle.

4. The method of claim 1, wherein the liquid containing the tobacco component comprises a liquid in which tobacco granules or tobacco fine particles are mixed with a liquid binder, and the applying of the liquid containing the tobacco component comprises applying the liquid containing the tobacco component comprising the tobacco granules or the tobacco fine particles having a size of about 10 μm to about 50 μm to the at least one surface of the sheet of the first non-tobacco material.

5. The method of claim 1, wherein the drying of the sheet of the first non-tobacco material comprises drying the sheet of the first non-tobacco material by using the drying device set to maintain a temperature in a range of about 70° C. to about 120° C.

6. The method of claim 1, wherein the forming of the aerosol generating rod comprises gathering the sheet of the first non-tobacco material in a transverse direction with respect to an axis of a conveying direction of the sheet of the first non-tobacco material;

forming a continuous rod by surrounding the gathered sheet of the first non-tobacco material with a wrapper; and forming the aerosol generating rod by cutting the continuous rod into a plurality of individual rods.

7. The method of claim 1, further comprising:

providing a sheet of a second non-tobacco material by using at least one second conveying roller;

crimping the sheet of the second non-tobacco material by using a second crimping device;

applying the aerosol generating material on at least one surface of the sheet of the second non-tobacco material by using a second spray nozzle; and forming a double sheet by overlapping the sheet of the second non-tobacco material and the sheet of the first non-tobacco material.

* * * * *